US006659085B2

(12) United States Patent
Kojima

(10) Patent No.: US 6,659,085 B2
(45) Date of Patent: Dec. 9, 2003

(54) HIGH-PRESSURE FUEL SUPPLY SYSTEM OF INTERNAL COMBUSTION ENGINE

(75) Inventor: Susumu Kojima, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 96 days.

(21) Appl. No.: 10/115,006

(22) Filed: Apr. 4, 2002

(65) Prior Publication Data

US 2002/0148443 A1 Oct. 17, 2002

(30) Foreign Application Priority Data

Apr. 12, 2001 (JP) ..... 2001-114399

(51) Int. Cl.[7] ..... F02M 37/04
(52) U.S. Cl. ..... 123/456; 123/179.17
(58) Field of Search ..... 123/179.17, 456, 123/514, 446, 497, 516, 506

(56) References Cited

U.S. PATENT DOCUMENTS 5,197,438 A * 3/1993 Kumano et al. ..... 123/506
5,598,817 A * 2/1997 Igarashi et al. ..... 123/179.17
6,058,912 A * 5/2000 Rembold et al. ..... 123/516
6,065,436 A * 5/2000 Koga et al. ..... 123/179.17
6,230,684 B1 * 5/2001 Furuhashi et al. ..... 123/467
6,234,128 B1 * 5/2001 Reuss ..... 123/179.17
6,257,204 B1 * 7/2001 Kamijo et al. ..... 123/456
6,336,445 B1 * 1/2002 Yamazaki et al. ..... 123/506

FOREIGN PATENT DOCUMENTS

| | | |
|---|---|---|
| JP | B2 2639017 | 4/1997 |
| JP | A 9-250426 | 9/1997 |
| JP | A 9-310661 | 12/1997 |
| JP | A-10-61468 | 3/1998 |
| JP | A 2000-18052 | 1/2000 |
| JP | A 2000-54926 | 2/2000 |

* cited by examiner

*Primary Examiner*—Carl S. Miller
(74) *Attorney, Agent, or Firm*—Oliff & Berridge, PLC

(57) ABSTRACT

A high-pressure fuel supply system of an internal combustion engine is provided which includes a high-pressure pump driven by the engine and operable with a cycle consisting of an intake stroke and a discharge stroke. The high-pressure pump includes a valve selectively placed in an open position to allow the fuel to be introduced into the pump and in a closed position to allow the fuel to be fed under pressure to a high-pressure portion located downstream of the high-pressure pump. A controller of the fuel supply system generates commands for closing the valve to the high-pressure pump during starting of the engine before the cylinders are discriminated from each other, such that a period of the generated commands is shorter than a half of the cycle of operation of the high-pressure pump during starting of the engine. After starting of the engine, the controller controls a duration of closing of the valve during the discharge stroke of the pump so that a regulated amount of the fuel is fed under pressure to the high-pressure portion.

10 Claims, 2 Drawing Sheets

HIGH-PRESSURE FUEL SUPPLY SYSTEM OF INTERNAL COMBUSTION ENGINE

INCORPORATION BY REFERENCE

The disclosure of Japanese Patent Application No. 2001-114399 filed on Apr. 12, 2001, including the specification, drawings and abstract, is incorporated herein by reference in its entirety.

BACKGROUND OF THE INVENTION

1. Field of the Invention

The invention relates to a high-pressure fuel supply system of an internal combustion engine.

2. Description of Related Art

In order to inject fuel directly into cylinders of the internal combustion engine, high-pressure fuel need be supplied to fuel injection valves corresponding to the respective cylinders. To this end, a high-pressure fuel supply system for supplying high-pressure fuel to the fuel injection valves is known in the art.

A generally known high-pressure fuel supply system includes a delivery pipe leading to each fuel injection valve, a high-pressure pump for feeding high-pressure fuel under pressure into the delivery pipe, and a low-pressure pump connected to the inlet side of the high-pressure pump in order to ensure entry or introduction of fuel into the high-pressure pump.

The high-pressure pump is an engine-driven pump that includes, e.g., a plunger that is slidably reciprocated within a cylinder by a cam moving in association with a crankshaft of the engine, a valve for opening and closing an inlet port of the cylinder, a spring for biasing the valve in a valve-opening direction (i.e., toward an open position), and a solenoid for closing the valve against the bias force of the spring.

When the plunger is under an intake stroke, the solenoid is held in a non-energized state, so that the valve is opened by the spring, and the fuel is introduced into the cylinder through the inlet port. When the plunger is under a discharge stroke, the solenoid is energized in response to a valve-closing signal applied thereto, so as to close the valve. Before the valve is closed, the fuel in the cylinder is returned to the low-pressure pump through the inlet port. After the valve is closed, the fuel in the cylinder is fed under pressure into the delivery pipe.

By controlling the timing of closing the valve in the discharge stroke, a suitably regulated amount of fuel can be fed under pressure into the delivery pipe. Thus, the amount of fuel fed to the delivery pipe can be controlled in accordance with the amount of fuel consumed at the delivery pipe, and the pressure in the delivery pipe can be maintained at around a desired high fuel pressure.

Upon a start of the engine, the fuel pressure in the delivery pipe is lowered to be approximately equal to the atmospheric pressure. Therefore, the fuel pressure in the delivery pipe need be raised quickly in order to achieve favorable fuel injection into the cylinders. It is therefore desirable to close the valve of the high-pressure pump at the same time that the discharge stroke starts, and feed the entire amount of fuel in the cylinder under pressure into the delivery pipe.

In the known fuel supply system, however, it is impossible to close the valve at the same time that the discharge stroke of the plunger starts for the following reason: in a starting period of the engine, it cannot be determined whether the high-pressure pump operating in synchronization with the crankshaft and a camshaft is in an intake stroke or a discharge stroke until a cylinder discrimination sensor identifies or discriminates individual cylinders from each other. (For example, the cylinder discrimination sensor is attached to the camshaft and generates a pulse each time the first cylinder reaches the top dead center of its intake stroke.) Accordingly, the valve is kept opened with the solenoid held in a non-energized state during a period from the start of cranking until the cylinders are discriminated from each other. With the valve thus kept opened, the high-pressure pump does not feed the fuel under pressure into the delivery pipe.

During the above period between the start of cranking and cylinder discrimination, the low-pressure pump, which is an electrically driven pump, is able to feed the fuel at the rated discharge pressure from the start of cranking. Thus, the discharge pressure of the low-pressure pump is applied to the delivery pipe through the high-pressure pump, whereby the delivery pipe can be raised to the rated discharge pressure of the low-pressure pump (e.g., 0.3 MPa). Nonetheless, this pressure is still much lower than the target high fuel pressure (e.g., 12 MPa) of the delivery pipe to be achieved in a normal operation of the engine, thus making it difficult to accomplish favorable fuel injection.

SUMMARY OF THE INVENTION

It is an object of the invention to provide a high-pressure fuel supply system of an internal combustion engine including an engine-driven high-pressure pump, which is capable of feeding a regulated amount of fuel under pressure from the high-pressure pump by controlling a duration of closing of a valve disposed at an inlet of the pump during a discharge stroke of the pump, and which is capable of feeding the fuel under pressure from the high-pressure pump in a starting period of the engine before cylinders are discriminated from each other, thereby to raise a fuel pressure in a high-pressure portion, such as a delivery pipe, to a sufficiently high level in a favorable manner.

To accomplish the above and/or other object(s), there is provided according to the invention a high-pressure fuel supply system of an internal combustion engine including a plurality of cylinders, which system includes a high-pressure pump driven by the internal combustion engine and operable with a cycle consisting of an intake stroke for receiving a fuel and a discharge stroke for delivering the fuel. The high-pressure pump includes a valve selectively placed in an open position to allow the fuel to be introduced into the high-pressure pump and in a closed position to allow the fuel to be fed under pressure to a high-pressure portion of the fuel supply system that is located downstream of the high-pressure pump. A controller of the fuel supply system generates commands for closing the valve to the high-pressure pump during starting of the engine before the cylinders are discriminated from each other, such that a period of the generated commands is shorter than a half of the cycle of operation of the high-pressure pump during starting of the engine, and, after starting of the engine, controls a duration of closing of the valve during the discharge stroke of the high-pressure pump so that a regulated amount of the fuel is fed under pressure to the high-pressure portion of the fuel supply system. With this arrangement, even before the cylinders are identified or discriminated from each other, the valve is closed during the discharge stroke of the high-pressure pump, and the fuel is fed under pressure from the high-pressure pump to the high-pressure portion of the system while the valve is being closed, whereby the fuel pressure in the high-pressure portion can be favorably raised to a sufficiently high level.

BRIEF DESCRIPTION OF THE DRAWINGS

The foregoing and/or further objects, features and advantages of the invention will become more apparent from the following description of preferred embodiments with reference to the accompanying drawings, in which like numerals are used to represent like elements and wherein.

DETAILED DESCRIPTION OF PREFERRED EMBODIMENTS

Figure 1:
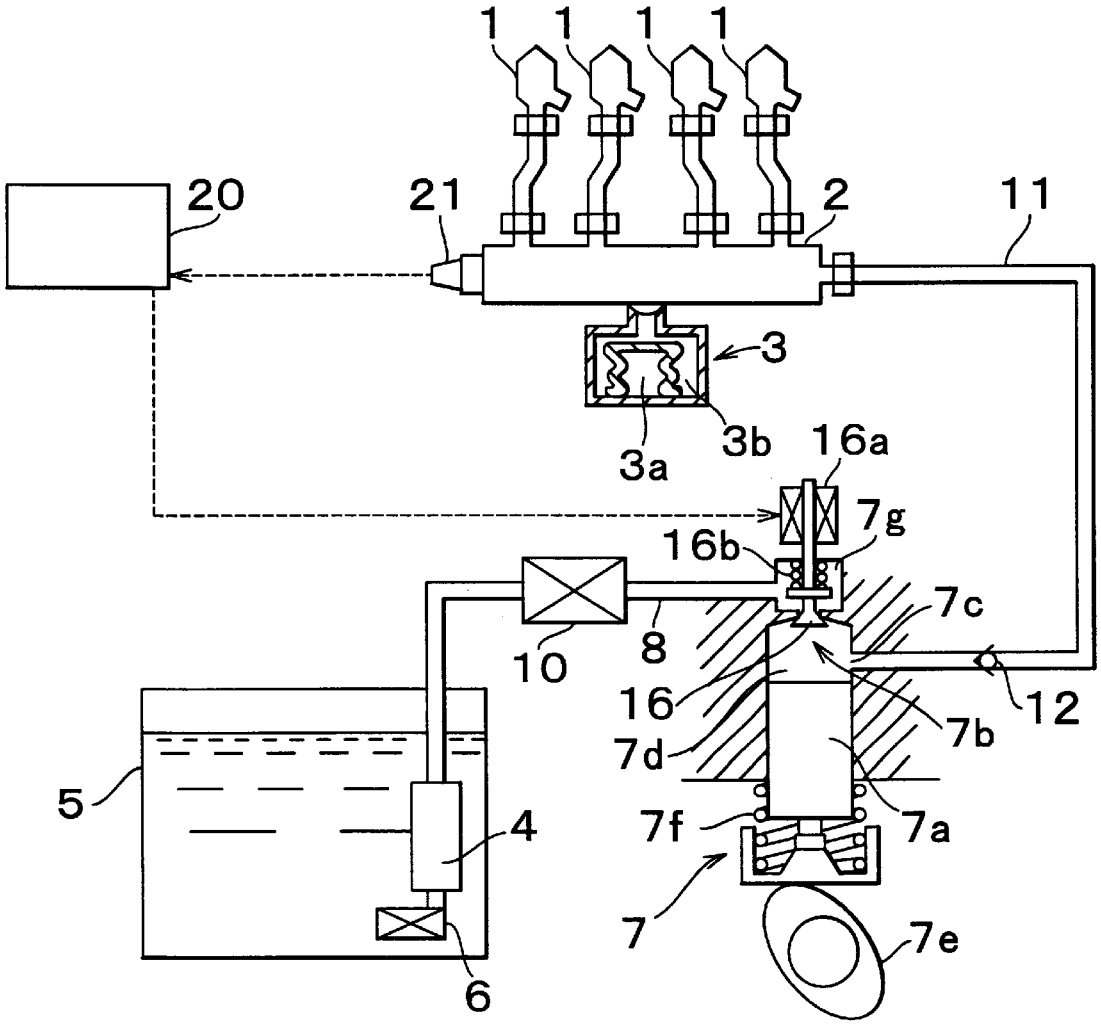
FIG. 1 is a view schematically showing a high-pressure fuel supply system according to one exemplary embodiment of the invention.

FIG. 1 schematically shows a high-pressure fuel supply system for an internal combustion engine according to one exemplary embodiment of the invention. In FIG. 1, the high-pressure fuel supply system includes fuel injection valves 1 that serve to inject fuel directly into the respective cylinders of the internal combustion engine. The fuel supply system further includes a delivery pipe 2 capable of supplying high-pressure fuel to each of the fuel injection valves 1, and a low-pressure pump 4 disposed within a fuel tank 5. The low-pressure pump 4 is a battery-driven, electric pump having a rated discharge pressure of, e.g., 0.3 MPa. The low-pressure pump 4 is actuated in response to an ON signal of a starter switch. A filter 6 is mounted on the intake side of the low-pressure pump 4 in order to remove foreign matters from the fuel pumped from the tank 5.

The high-pressure fuel supply system further includes a high-pressure pump 7 that functions to keep the fuel pressure in the delivery pipe 2 at a sufficiently high level close to a target fuel pressure. The high-pressure pump 7 is an engine-driven pump that is driven by a cam 7*e* that moves with a crankshaft of the engine. In operation of the high-pressure pump 7, a fuel is introduced into a cylinder 7*d* via an inlet port 7*b*, and is discharged through an outlet port 7*c*. To enable this operation, the high-pressure pump 7 includes a plunger 7*a* capable of sliding within the cylinder 7*d*. The inlet port 7*b* is connected to the discharge side of the low-pressure pump 4 via a low-pressure pipe 8, and the outlet port 7*c* is connected to the delivery pipe 2 via a high-pressure pipe 11. A filter 10 is disposed in the low-pressure pipe 8 in order to remove foreign matters from the fuel.

The plunger 7*a* is moved downward under bias force of a spring 7*f* so as to increase the volume of space in the cylinder 7*d* during each intake stroke of the high-pressure pump 7, and is moved upward by the cam 7*e* so as to reduce the volume of the space in the cylinder 7*d* during each discharge stroke of the pump 7. A valve 16 is provided for opening and closing the inlet port 7*b*. A spring 16*b* is provided above the valve 16 for constantly biasing the valve 16 in a valve-opening direction (i.e., downward in FIG. 1). A solenoid 16*a* serves to move the valve 16 in a valve-closing direction (i.e., upward in FIG. 1) against the bias force of the spring 16*b*. The solenoid 16*a* is not energized during the intake stroke of the high-pressure pump 7, and the valve 16 is opened under the bias force of the spring 16*b*, so that the fuel is introduced from the low-pressure pipe 8 into the cylinder 7*d* through the inlet port 7*b*. Since the pressure of the fuel is raised o 0.3 MPa by the low-pressure pump 4 as described above, no fuel vapor is generated within the low-pressure pipe 8 due to a negative pressure therein during the intake stroke of the high-pressure pump 7.

During the discharge stroke of the high-pressure pump 7, on the other hand, the solenoid 16*a* is energized at a desired point of time so as to close the valve 16. Before the valve 16 is closed, the fuel in the cylinder 7*d* is returned to the low-pressure pump 4 through the low-pressure pipe 8 without being fed under pressure into the high-pressure delivery pipe 2. After the valve 16 is closed, however, the fuel in the cylinder 7*d* is fed under pressure into the delivery pipe 2. In the high-pressure fuel supply system of this embodiment, the high-pressure pump 7 is brought into a discharge stroke each time the fuel is injected into two cylinders. Thus, the fuel, which is regulated to an amount used for fuel injection into the two cylinders, is fed under pressure to the delivery pipe during each discharge stroke. In this manner, the fuel pressure in the delivery pipe 2 can be kept at a high level close to the target fuel pressure.

A check valve 12, which is designed to be opened at a predetermined pressure, is mounted in the high-pressure pipe 11 in order to prevent reverse flow of the fuel due to pressure pulsation generated by the high-pressure pump 7. A pressure sensor 21 is provided for monitoring the fuel pressure in the delivery pipe 2.

As described above, an unnecessary portion of the fuel discharged from the plunger 7*a* is returned to the fuel tank 3 through the low-pressure pipe 8, which would causes a high-pressure fuel to flow backward through the low-pressure pump 4. In order to prevent such reverse flow, the low-pressure pipe 8 may communicate with the fuel tank 5 through a safety valve adapted to be opened at a pressure slightly higher than the rated discharge pressure of the low-pressure pump 4.

Once the high-pressure pump 7 operates in a favorable manner after a start of the engine, the fuel can be discharged as desired and the pressure in the delivery pipe 2 can be kept at a high level close to the target fuel pressure. As a result, the fuel can be injected through the fuel injection valves 1 in a favorable manner. At the time of a start of the engine, however, favorable fuel injection cannot be accomplished unless the fuel pressure in the delivery pipe 2 is quickly raised from a level approximately equal to the atmospheric pressure. Accordingly, it is desired to close the valve 16 as soon as the discharge stroke of the high-pressure pump 7 starts, and to feed the entire amount of fuel in the cylinder 7*d* under pressure into the delivery pipe 2.

However, the valve 16 cannot be closed at the same time that the discharge stroke of the high-pressure pump 7 starts for the following reason: upon a start of the engine, it is impossible to discriminate the cylinders of the engine from each other, and determine the current stroke of each cylinder, (namely, the crank angle of the crankshaft cannot be determined), until a pulse signal is received from a cylinder discrimination sensor adapted to generate a pulse at a top dead center of each intake stroke of the first cylinder, and the cylinders are discriminated from each other. Since the crank angle cannot be determined, it cannot be determined whether the high-pressure pump 7 operating in association with the crankshaft is in the intake stoke or discharge stroke. In general, therefore, the solenoid 16*a* is kept in a non-energized state, and the valve 16 is kept opened, during at least a period from a start of a cranking operation to a point of time when the cylinders can be discriminated from each other. With the valve 16 thus kept opened, the fuel is not fed under pressure from the high-pressure pump 7 to the delivery pipe 2.

In the meantime, the electric low-pressure pump 4, which is driven by electric power, is able to feed fuel at the rated discharge pressure from the start of the cranking operation. During the above-described period, therefore, the fuel discharged from the low-pressure pump 4 is supplied to the delivery pipe 2 through the cylinder 7*d* of the high-pressure pump 7, so that the fuel pressure in the delivery pipe 2 can be raised to the rated discharge pressure (e.g., 0.3 MPa) of the low-pressure pump 4. However, this pressure is much lower than the target high fuel pressure of the delivery pipe (e.g., 12 MPa) in normal use. It is thus difficult to provide the delivery pip 2 with a sufficiently high pressure, and achieve desirable fuel injection.

Figure 2:
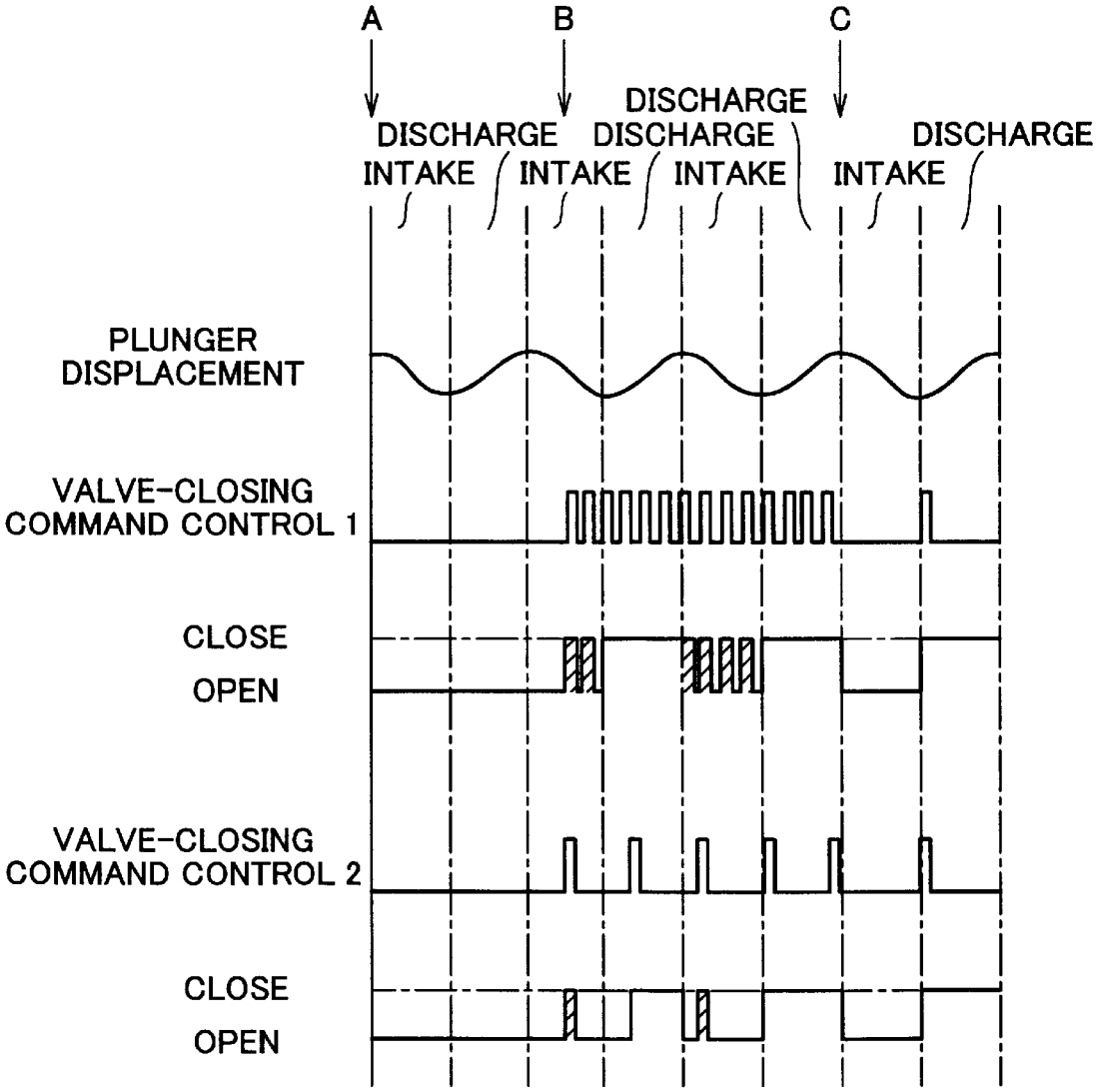
FIG. 2 is a timing chart illustrating control of a high-pressure pump of the high-pressure fuel supply system of FIG. 1.

As shown in FIG. 1, a controller 20 is provided for controlling the high-pressure fuel supply system of this embodiment according to the timing chart of FIG. 2. The fuel supply system is controlled in order to feed the fuel under pressure from the high-pressure pump 7 from a point of time before the cylinders are identified or discriminated from each other upon a start of the engine. This operation makes it possible to favorably raise a fuel pressure within the delivery pipe 2, namely, a fuel pressure in a high-pressure portion of the system located downstream of the high-pressure pump 7. (In the case where the check valve 12 is disposed downstream of the high-pressure pump 7, the above-indicated high-pressure portion is located downstream of the check valve 12.)

In FIG. 2, time A indicates a start of a cranking operation in response to an ON signal of the starter switch. As the crankshaft is rotated, the plunger 7*a* of the high-pressure pump 7 displaces or moves up and down, and the high-pressure pump 7 repeats an intake stroke for introducing fuel into the cylinder 7*d* and a discharge stroke for discharging the fuel from the cylinder 7*d*. In FIG. 2, the plunger 7*a* starts operating from the top dead center of the intake stroke. It is, however, to be understood that the plunger 7*a* may start operating from any location other than the top dead center, which location may be determined when the engine is stopped last time.

Upon a start of cranking of the engine, the electrically-driven low-pressure pump 4 is activated so as to start discharging fuel at the rated discharge pressure. In the initial period of the cranking operation, no command to close the valve 16 is given to the high-pressure pump 7, and the solenoid 16*a* is kept in a non-energized state, whereby the valve 16 is kept opened by the spring 16*b*. As a result, the fuel discharged from the low-pressure pump 4 is fed under pressure into the high-pressure portion of the system through the cylinder 7*d* of the high-pressure pump 7, thereby raising the fuel pressure in the high-pressure portion from a level approximately equal to the atmospheric pressure. The fuel pressure in the delivery pipe 2 is monitored by the pressure sensor 21. Time B as shown in FIG. 2 indicates a point of time when the fuel pressure in the delivery pipe 4 reaches the rated discharge pressure of the low-pressure pump 4. While time B is determined by directly monitoring the fuel pressure in the delivery pipe 2 in this embodiment, time B may also be determined by estimating the fuel pressure in the high-pressure portion based on the operating time of the low-pressure pump 4, or other parameter(s).

At time B, the low-pressure pump 4 cannot raise the fuel pressure in the high-pressure portion to a higher level than the rated pressure. At this time, therefore, a command in the form of a pulse signal to close the valve 16 is given to the solenoid 16*a*, as indicated in a portion of the timing chart of FIG. 2 labeled "valve-closing command control 1", so as to activate the high-pressure pump 7. It is more preferable to provide a pulse signal having a shorter pulse period. Here, a period of pulses, or a pulse period, is defined as an interval between rises of adjacent two pulses. If the high-pressure pump 7 is in the intake stroke at the time B, the valve 16 is closed every time the solenoid 16*a* is energized in response to a valve-closing pulse, as shown in a portion of the timing chart of FIG. 2 immediately below the row of "valve-closing command control 1". Since the solenoid 16*a* is not energized between adjacent valve-closing pulses, the valve 16 is opened under the bias force of the spring 16*b* during this period. With the valve 16 thus opened, a sufficiently large amount of fuel can be introduced into the cylinder 7*d*.

In the following discharge stroke of the high-pressure pump 7, the fuel pressure in the cylinder 7*d* is raised once the valve 16 is closed in response to a valve-closing pulse, and therefore the valve 16 will not be opened by the spring 16*b* even if the solenoid 16*a* is not energized between adjacent valve-closing pulses. If the period (or interval) of valve-closing pulses is shortened, and the valve 16 can be opened substantially at the same time that the discharge stroke starts, the high-pressure pump 7 is able to deliver almost the entire amount of the fuel in the cylinder 7*d*, to thereby raise the fuel pressure in the high-pressure portion to a sufficiently high level.

In the following intake stroke of the high-pressure pump 7, the valve 16 is closed in response to each valve-closing pulse, and the fuel is introduced into the cylinder 7*d* while the valve 16 is opened between adjacent valve-closing pulses. Thus, the fuel introduced during opening of the valve 16 can be fed under pressure to the high-pressure portion of the fuel supply system during the subsequent discharge stroke. Time C indicates a point of time at which the cylinders are identified or discriminated from each other. Once cylinder identification or discrimination is accomplished, only a single valve-closing pulse need be applied at the time of a start of each discharge stroke subsequent to time C. In this manner, the high-pressure pump 7 is able to deliver the entire amount of the fuel in the cylinder 7*d* under pressure.

It is desirable to shorten the duration of one valve-closing pulse as much as possible as long as the valve-closing pulse can cause the valve 16 to be reliably closed against the bias force of the spring 16*b*. Reduction in the valve-closing pulse duration leads to reduction in the valve-closing pulse period. With the pulse period thus reduced, a valve-closing pulse is more likely to be applied at the time of a start of a discharge stroke, making it more likely for the high-pressure pump 7 to deliver the entire amount of fuel in the cylinder 7*d*. This is advantageous in raising the fuel pressure in the high-pressure portion to a sufficiently high level. If the duration of one valve-closing pulse is too long, the valve 16 would be closed for a long time each time a valve-closing pulse is received , in accordance with the valve-closing pulse duration, during each intake stroke between time B and time C. This makes it difficult to introduce a sufficient amount of fuel into the cylinder 7*d* during the intake stroke.

A portion of the timing chart of FIG. 2 labeled "valve-closing command control 2" indicates another example of a pulse command to close the valve. Only differences between the valve-closing command controls 1 and 2 will be now described. The pulse period of the valve-closing pulse signal used in the control 2 is slightly shorter than a half of the cycle of operation of the high-pressure pump 7, which cycle consists of an intake stroke and a discharge stroke. With the valve-closing command control 2, too, a valve-closing pulse is applied without fail during each discharge stroke, so that the valve 16 is kept closed at least after the valve-closing pulse is applied during the discharge stroke. Thus, the high-pressure pump 7 is able to deliver the fuel under pressure into the high-pressure portion of the fuel supply system. During each intake stroke, the valve 16 is closed for a short period of time equal to the duration of the valve-closing pulse applied thereto, but is held opened for the rest of the stroke other than the short pulse duration. Thus, a sufficiently large amount of fuel can be supplied to the cylinder 7*d* during the intake stroke.

The above-indicated cycle of operation of the high-pressure pump 7 varies depending on the revolution speed of the crankshaft, i.e., the engine speed. Accordingly, the cycle of the high-pressure pump 7 used for setting the pulse period must be determined in accordance with the engine speed upon cranking, namely, at the time of a start of the engine. The engine speed upon cranking may have a predetermined value or may be detected by a revolution sensor. For example, the revolution sensor generates a pulse per crank angle of 30°, and determines the engine speed by measuring time between adjacent pulses thus generated. It is thus possible to detect the engine speed without identifying or discriminating the cylinders from each other.

If a command in the form of a pulse signal to close the valve 16 is applied to the solenoid 16*a* such that the period of pulses is shorter than a half of the cycle of operation of the high-pressure pump 7, as described above, the valve 16 can be closed for some time during each discharge stroke. Thus, as compared with the case where the valve 16 is kept opened during each discharge stroke, the fuel in the cylinder 7*d* can be fed under pressure to the high-pressure portion at least after the valve 16 is closed, and therefore the fuel pressure in the high-pressure portion can be raised to a level higher than the rated discharge pressure of the low-pressure pump.

In this high-pressure fuel supply system of the present embodiment, no command to close the valve 16 is given to the high-pressure pump 7 until the fuel pressure in the high-pressure portion reaches the rated discharge pressure of the low-pressure pump 4. In other words, the valve 16 is kept opened until the fuel pressure in the high-pressure portion reaches the rated discharge pressure of the low-pressure pump 4. This is because the electric low-pressure pump 4 operates in a favorable manner upon a start of the engine, and the amount of fuel per unit time discharged by the low-pressure pump 4 is generally larger than that discharged by the high-pressure pump 7 during cranking of the engine. Thus, the time required for raising the fuel pressure in the high-pressure portion to the rated discharge pressure of the low-pressure pump 4 can be advantageously reduced. It is, however, to be understood that the invention is not limited to this manner of applying a command signal. For example, a command in the form of a pulse signal to close the valve 16 may be periodically applied to the high-pressure pump at the same time that a cranking operation is started.

If pulses for closing the valve 16 are periodically applied to the high-pressure pump 7 as described above, the valve 16 is closed even during the intake stroke for one or more short periods indicated by hatched portions in FIG. 2. Such closing of the valve 16 is deemed unnecessary because that makes it difficult to introduce a sufficient amount of fuel into the cylinder 7*d*, and may result in reduction in the service life of the valve 16. Thus, it is not preferable or desirable to close the valve 16 during the intake stroke.

The valve 16 is constantly biased in the valve-opening direction (i.e., toward its open position) under a first bias force of the spring 16*b*. In order to close the valve 16, the solenoid 16*a* is required to generate a second bias force that is larger than the first bias force to move the valve 16 in the valve-closing direction (i.e., toward its closed position). If the second bias force is set to be sufficiently larger than the first bias force, the valve 16 can be closed with high reliability. It is therefore preferable that the solenoid 16*a* is capable of generating a relatively large second bias force. After the cylinders are identified or discriminated from each other, a relatively large second bias force is generated by the solenoid 16*a*, so that the valve 16 can be reliably closed at a desired point of time in each discharge stroke, depending upon whether the entire amount or a regulated amount of the fuel in the cylinder 7*d* is to be delivered from the high-pressure pump 7.

When a command signal to close the valve 16 is generated before the cylinders are identified or discriminated from each other, however, a reduced voltage is applied to the solenoid 16*a*, for example, so that the solenoid 16*a* generates a second bias force that is slightly larger than the first bias force of the spring 16*b*. In this manner, the valve 16 can be closed during the discharge stroke, but cannot be closed during the intake stroke. Namely, during the intake stroke, a pressure difference between the low-pressure pipe 8 and the cylinder 7*d* upon introduction of the fuel into the cylinder 7*d*, as well as the first bias force of the spring 16*b*, is applied to the valve 16 in the valve-opening direction, and therefore the valve 16 cannot be closed against the pressure difference if the second bias force is only slightly larger than the first bias force. Thus, the valve 16 can be prevented from being closed during the intake stroke.

In the high-pressure fuel supply system of this embodiment, the spring 16*b* that generates the first bias force consists of a compression spring. In the strict sense, therefore, the first bias force is not constant while the valve 16 moves from a fully open position to a fully closed position. In other words, the first bias force varies with a degree of compression of the spring 16*b*. Moreover, the pressure difference that is applied to the valve 16 during the intake stroke is not constant, but varies depending upon the position of the plunger 7*a*. It is therefore preferable to set the second bias force, taking account of variations in the first bias force and the pressure difference, so that the valve 16 can be closed during the discharge stroke but cannot be closed during the intake stroke.

The high-pressure fuel supply system of the present embodiment includes an accumulator 3 connected to the delivery pipe 2. The accumulator 3 has a fuel chamber 3*b* communicating with the delivery pipe 2, and a gas chamber 3*a* separated from the fuel chamber 3*b* by a bellows (or a diaphragm or a piston). The gas chamber 3*a* is charged with an inert gas, such as nitrogen, at a preset pressure. The total effective volume of the delivery pipe 2, which includes the volume of the fuel chamber 3*b* of the accumulator 3 with the gas chamber 3*a* being expanded, is smaller than that of a normal delivery pipe.

When the fuel pressure in the delivery pipe 2 gets close to the target high fuel pressure set for normal running of the engine, the gas chamber 3*a* of the accumulator 3 contracts sufficiently, and the fuel chamber 3*b* has an increased volume. At this time, the total effective volume of the delivery pipe 2, which includes the increased volume of the fuel chamber 3*b*, is about the same as that of the normal delivery pipe. During normal running of the engine, therefore, the fuel pressure in the delivery pipe 2 is not significantly reduced from the target high fuel pressure even if a large amount of fuel is injected from the delivery pipe 2. Since the compressibility of the gas contained in gas chamber 3*a* is larger than that of the fuel, the pressure in the delivery pipe 2 is less likely to be reduced as compared with the case where the normal delivery pipe is used. In view of this fact, the total effective volume of the delivery pipe 2, which includes the increased volume of the fuel chamber 3*b*, may be set smaller than that of the normal delivery pipe.

At the time of a start of the engine, too, the fuel is preferably injected at the target high fuel pressure (e.g., 12 MPa) set for normally running of the engine. However, fuel injection at the target fuel pressure upon a start of the engine is not practical because it takes a considerably long time to raise the fuel pressure to the target fuel pressure. As described above, it is difficult to perform desirable fuel injection at the rated discharge pressure of the low-pressure pump 4 (e.g., 0.3 MPa), but relatively good or favorable fuel injection can be performed at a fuel pressure of, for example, about 4 MPa. Accordingly, the required pressure for starting of the engine is normally set to a level between the rated discharge pressure of the low-pressure pump 4 and the target high fuel pressure.

It is thus possible to start fuel injection when the fuel pressure in the delivery pipe 2 reaches the required starting pressure. In view of the contraction force of the bellows itself, the pressure at which the gas chamber 3*a* of the accumulator 3 is charged with inert gas is predetermined so that the gas chamber 3*a* does not contract until the fuel pressure in the delivery pipe 2 gets close to the required starting pressure. Accordingly, the high-pressure portion of the fuel supply system has a relatively small volume until the fuel pressure in the delivery pipe 2 rises to the required starting pressure. This allows the fuel pressure to be raised more quickly to the rated discharge pressure by the low-pressure pump 4 and to the required starting pressure by the high-pressure pump 7 upon starting of the engine. Consequently, fuel injection can be started in an early period after cranking.

In the illustrated embodiment, the valve 16 for opening and closing the inlet port of the high-pressure pump 7 is opened by the spring 16*b* and closed by the solenoid 16*a*. However, the invention is not limited to this arrangement. For example, the valve may be opened and closed by means of a step motor or the like. In this case as well, it is possible to control the step motor, or the like, so that the valve is closed at intervals each of which is shorter than a half of the cycle of operation of the high-pressure pump consisting of an intake stroke and a discharge stroke, upon a start f the engine before the cylinders are identified or discriminated from each other. Even if the valve-opening force is considerably large and the valve is opened even in the discharge stroke, the fuel is fed under pressure to the high-pressure portion at least when the valve is in the closed position during the discharge stroke. Thus, the fuel pressure in the high-pressure portion can be raised in a more favorable manner as compared to the case where the valve is kept opened until the cylinders are discriminated from each other.

What is claimed is:

1. A high-pressure fuel supply system of an internal combustion engine including a plurality of cylinders, comprising:

a high-pressure pump driven by the internal combustion engine and operable with a cycle consisting of an intake stroke for receiving a fuel and a discharge stroke for delivering the fuel, the high-pressure pump comprising a valve selectively placed in an open position to allow the fuel to be introduced into the high-pressure pump and in a closed position to allow the fuel to be fed under pressure to a high-pressure portion of the fuel supply system that is located downstream of the high-pressure pump; and a controller that:

generates commands for closing the valve to the high-pressure pump during starting of the engine before the cylinders are discriminated from each other, such that a period of the generated commands is shorter than a half of the cycle of operation of the high-pressure pump during starting of the engine; and after starting of the engine, controls a duration of closing of the valve during the discharge stroke of the high-pressure pump so that a regulated amount of the fuel is fed under pressure to the high-pressure portion of the fuel supply system wherein the valve is constantly biased under a first force in a valve-opening direction, and is moved by a second force in a valve-closing direction in response to the commands, and wherein a magnitude of the second force is determined so that the valve can be closed by the second force against the first force during the discharge stroke of the high-pressure pump, but cannot be closed by the second force during the intake stroke of the high-pressure pump with the first force and a pressure difference on opposite sides of the valve being applied to the valve in a valve-opening direction.

2. The high-pressure fuel supply system according to claim 1, further comprising:

an electric low-pressure pump connected to an inlet side of the high-pressure pump and having a rated discharge pressure, the low-pressure pump being actuated upon a start of the engine so as to increase a fuel pressure in the high-pressure portion, wherein after the fuel pressure in the high-pressure portion is raised to a level close to the rated discharge pressure of the low-pressure pump, the controller starts applying the commands to the high-pressure pump until the cylinders are discriminated from each other.

3. The high-pressure fuel supply system according to claim 1, wherein the high-pressure pump further comprises a spring that generates the first force, and a solenoid that generates the second force when energized.

4. The high-pressure fuel supply system according to claim 2, wherein the valve is constantly biased under a first force in a valve-opening direction, and is moved by a second force in a valve-closing direction in response to the commands, and wherein a magnitude of the second force is determined so that the valve can be closed by the second force against the first force during the discharge stroke of the high-pressure pump, but cannot be closed by the second force during the intake stroke of the high-pressure pump with the first force and a pressure difference on opposite sides of the valve being applied to the valve in a valve-opening direction.

5. The high-pressure fuel supply system according to claim 1, further comprising an accumulator connected to the high-pressure portion of the fuel supply system, the accumulator having a gas chamber containing a gas at a pressure that is set so that the gas chamber does not contract until a fuel pressure in the high-pressure portion of the fuel supply system becomes approximately equal to a predetermined level required for starting of the engine.

6. The high-pressure fuel supply system according to claim 2, further comprising an accumulator connected to the high-pressure portion of the fuel supply system, the accumulator having a gas chamber containing a gas at a pressure that is set so that the gas chamber does not contract until a fuel pressure in the high-pressure portion of the fuel supply system becomes approximately equal to a predetermined level required for starting of the engine.

7. The high-pressure fuel supply system according to claim 1, further comprising an accumulator connected to the high-pressure portion of the fuel supply system, the accumulator having a gas chamber containing a gas at a pressure that is set so that the gas chamber does not contract until a fuel pressure in the high-pressure portion of the fuel supply system becomes approximately equal to a predetermined level required for starting of the engine.

8. The high-pressure fuel supply system according to claim 1, wherein the period of the commands is determined such that one of the commands is generated substantially at a beginning of each discharge stroke of the high-pressure pump.

9. The high-pressure fuel supply system according to claim 1, wherein the commands comprise pulses, and the period of commands is a period of the pulses defined as an interval between rises of adjacent two pulses.

10. The high-pressure fuel supply system according to claim 1, wherein the high-pressure pump includes a cylinder having a discharge port, and a plunger received in the cylinder, and wherein the valve is disposed between an inlet port of the high-pressure pump and the cylinder.

* * * * *